United States Patent [19]

Maillard

[11] 4,015,356

[45] Apr. 5, 1977

[54] REVOLVER CYLINDER FOR THE EJECTION OF RIMLESS CARTRIDGE CASES

[75] Inventor: Gilbert Maillard, Montbeliard, France

[73] Assignee: Manufacture de Machines du Haut-Rhin S.A., Mulhouse Cedex, France

[22] Filed: June 10, 1975

[21] Appl. No.: 585,697

[30] Foreign Application Priority Data

June 11, 1974 France ..... 74.20125

[52] U.S. Cl. ..... 42/68

[51] Int. Cl.[2] ..... F41C 15/00

[58] Field of Search ..... 42/68, 59, 62, 89

[56] References Cited

UNITED STATES PATENTS

| | | | |
|---|---|---|---|
| 923,068 | 5/1909 | Neal | 42/89 |
| 1,181,417 | 5/1916 | Wesson | 42/68 |
| 3,755,950 | 9/1973 | Gunn | 42/68 |

*Primary Examiner*—Charles T. Jordan

[57] ABSTRACT

Revolver cylinder provided with a mechanism for the ejection of rimless cartridge casings, and a revolver incorporating such cylinder. The ejector has a head with a plurality of part-circular cutout portions which are disposed in alignment with the chambers in the cylinder. Each of such cutout portions in the head has a peripheral groove in which there is disposed a generally part-circular leaf spring which is adapted to fit within the annular groove in the rear end of the cartridge casing and to engage the casing at two diametrically opposed zones.

5 Claims, 6 Drawing Figures

REVOLVER CYLINDER FOR THE EJECTION OF RIMLESS CARTRIDGE CASES

The present invention relates to the cylinder of a revolver provided with an ejection mechanism for rimless cartrdige cases. Such mechanism effects the simultaneous ejection of all of the cartridge cases in the cylinder; it includes a common ejector means having a generally disc-shaped head having a plurality of equally angularly spaced cutout portions along its periphery, such cutout ortions being aligned with the chambers in the cylinder of the revolver. The invention also relates to a revolver provided with such a cylinder. Revolver cylinders provided with cartridge case ejecting mechanisms are well-known, but prior ejecting mechanisms are usually used only with ammunition which has a rim or collar on the rear end of the cartridge case. With such ammunition, the rim or flange of the cartridge, when the cartridge is fully insterted into the chamber of the cylinder, is received within an annular seat made up in part of a groove in the rear of the cylinder and in part by a portion of the head of the ejector. The head of the ejector, in engaging the forward surface of the rim of flange on the cartridge case, permits the ejection of the cartridge case when the ejector head is thrust rearwardly away from the revolver cylinder proper.

In contrast to the above, the present invention relates to the cylinder of a revolver designed for use with rimless cartridges, that is, those having no rim or flange on their rear ends but presenting an annular groove near the rear end of the cartridge casing, for example, 9 mm cartridges of the type designated "parabellum" which are presently used in a number of different automatic handguns. With such ammunition, each cartridge is positioned in a chamber of the cylinder by means of an annular shoulder which is disposed between the rear end of the projectile or ball and the forward end of the cartridge case, the annular shoulder on the cartridge engaging an annular shoulder within the chamber of the cylinder. The present invention provides a cylinder provided with an ejector mechanism which permits the ejection of the cases of cartridges devoid of rims or flanges on their bases or rear ends.

In accordance with the present invention, the head of the common ejecting mechanism is provided in the zone of each cutout portion therein with elastic means which is adapted to engage within the annular groove at the rear end of the cartridge case and to cooperate with such groove at the end of its introduction into the respective chamber, the cartridge case remaining in engagement with such resilient means from the time when it is fully inserted into the chamber of the cylinder until its complete ejection therefrom.

In accordance with a preferred embodiment of the invention, the head of the common ejector means presents a groove which extends completely about its periphery including the cutout portions in such head. Such peripheral groove in the head is disposed in the same plane as the annular grooves at the rear end of the cartridge cases when such cases are fully inserted into the respective chambers in the cylinder with the annular shoulder between the forward end of the cartridge casing and the projectile or ball engagement with the annular shoulder within the chamber of the cylinder. In such embodiment, the said peripheral groove is provided in each of the cutout portions thereof with the above-described elastic means which is engaged within the respective grooves at the rear end of the cartridge casings.

In a particularly advantageous embodiment of the invention, such elastic retaining means are constituted by a plurality of generally U-shaped or semicircular leaf springs which enter within the annular groove at the rear end of the cartridge casings at two diametrically opposed zones.

The invention is described below in more detail in reference to the appended drawings which illustrate a preferred embodiment of the invention by way of non-limiting example thereof.

Figure 3:
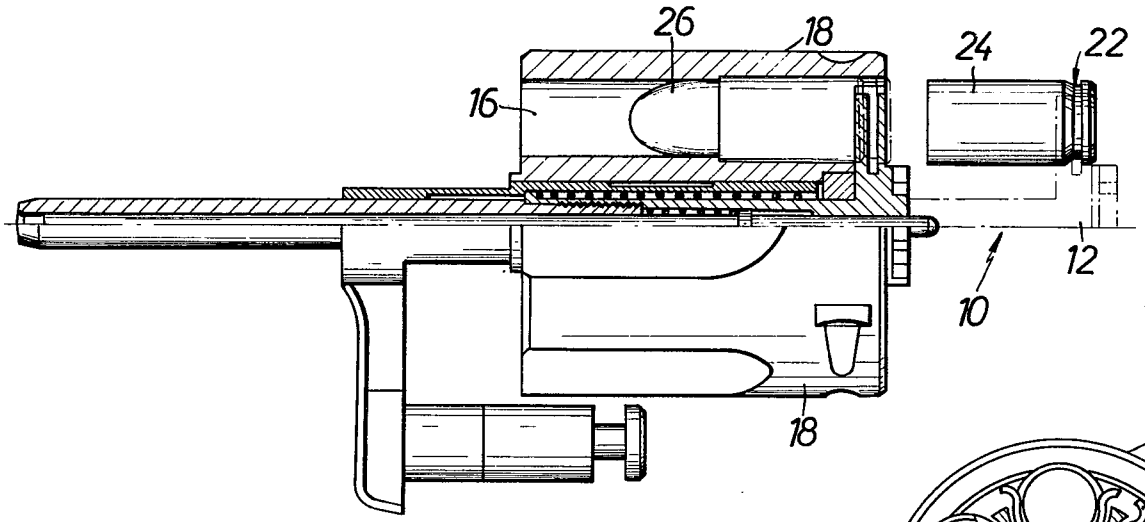
Figure 4:
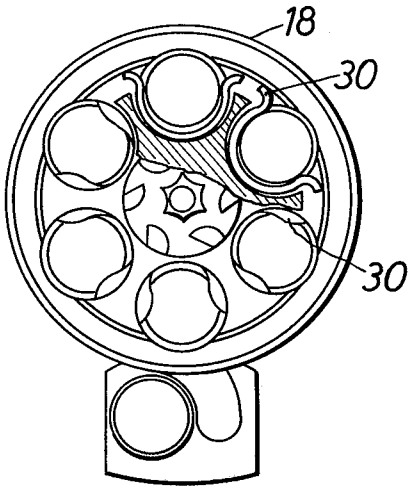
Figure 5:
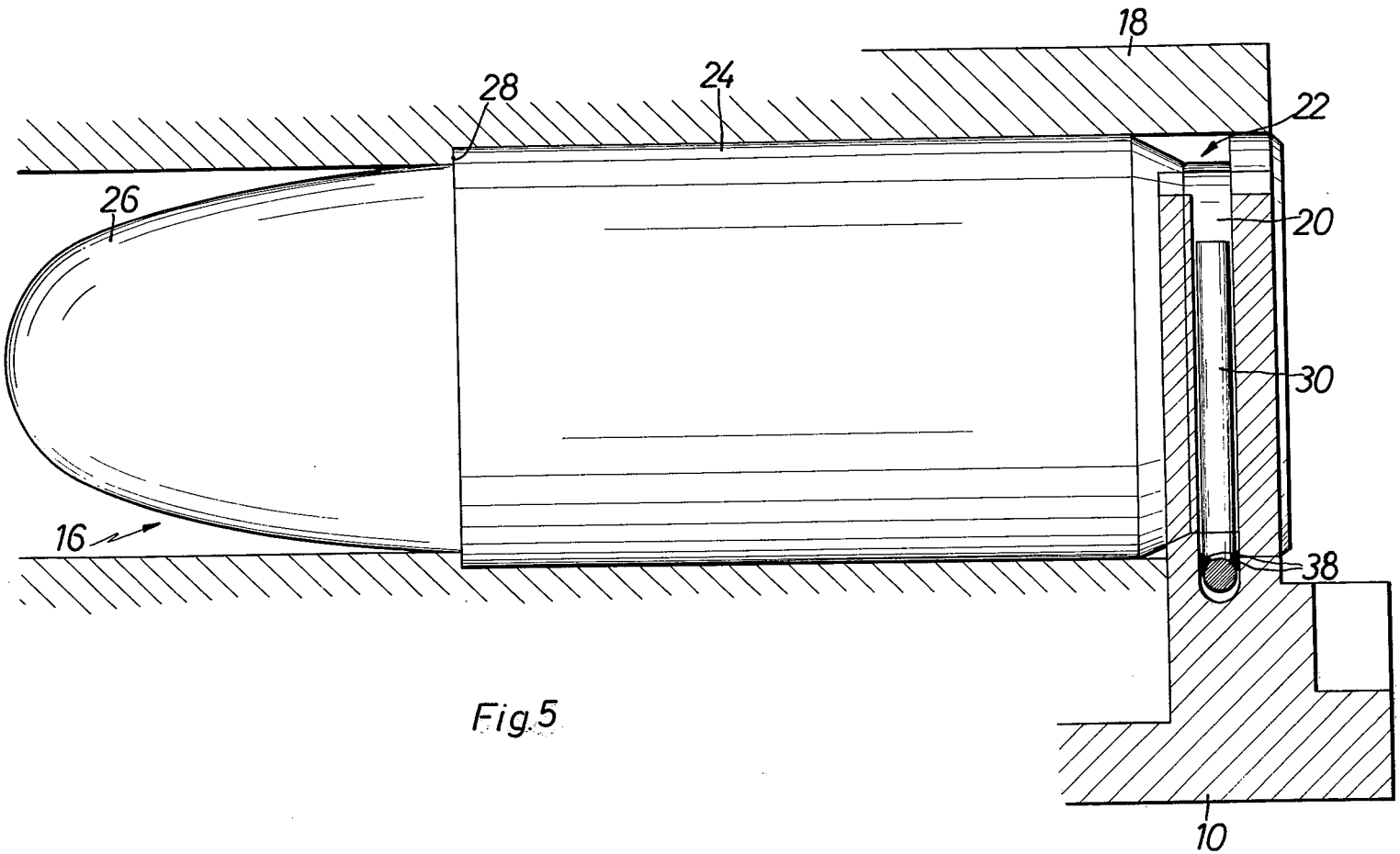
Figure 6:
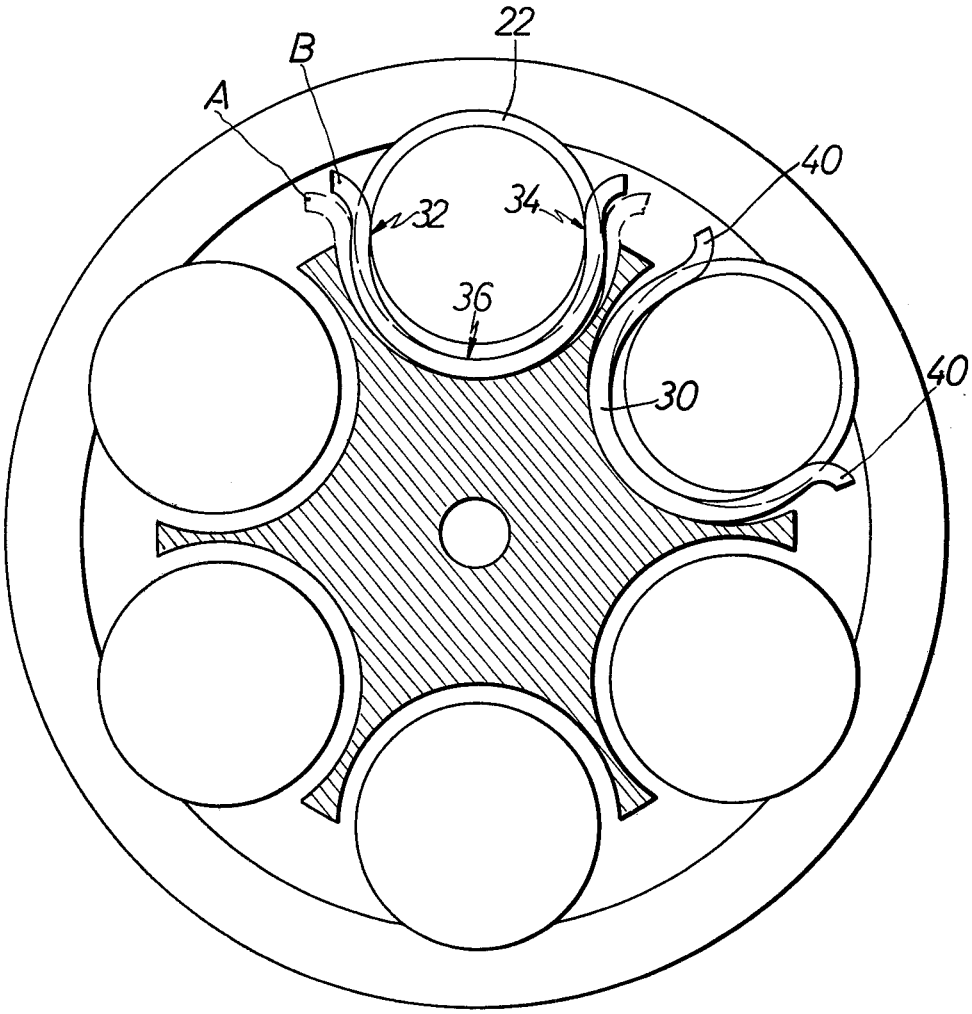

FIG. 3 is a view partially in vertical axial section and partially in side elevation of a revolver cylinder in accordance with the invention, said view showing a portion of the common ejector mechanism, such mechanism being shown positioned at the right generally within the cylinder with a cartridge shown in phantom lines fully inserted within an upper chamber of the cylinder, the common ejector mechanism being shown in phantom lines extended to the right to eject a cartridge casing;

FIG. 4 is a view in end elevation taken in the direction from right to left in FIG. 3, a portion of the head of the ejector means in the zone of two upper cutout portions thereof being broken away to show two U-shaped leaf springs;

FIG. 5 is fragmentary view partially in vertical axial section and partially in side elevation of the revolver cylinder of the invention at the location of one of the chambers therein, the view being on a scale which is greatly enlarged with respect to the other figures of the drawings; and FIG. 6 is a fragmentary view in vertical cross-section through the revolver cylinder of the invention, In the drawings, similar parts throughout the several views are designated by the same reference characters.

Turning now to the drawings, the common ejector means 10 is provided with a head 12 disposed in a plane at right angles to the longitudinally extending stem thereof, the head 12 being generally in the form of a disc and having six equally angularly spaced cutout portions 14 in its periphery. These cutout portions 14 are accurately located in alignment with the respective chambers 16 in the cylinder 18 of the revolver, and thus permit the insertion of loaded cartridges into such chambers 16 of the cylinder. Conventional means, not particularly shown, mount the stem of the ejector means 10 within the cylinder for turning therewith, while permitting the ejector means to move between the solid line and the phantom line positions there shown in FIG. 3.

Figure 1:
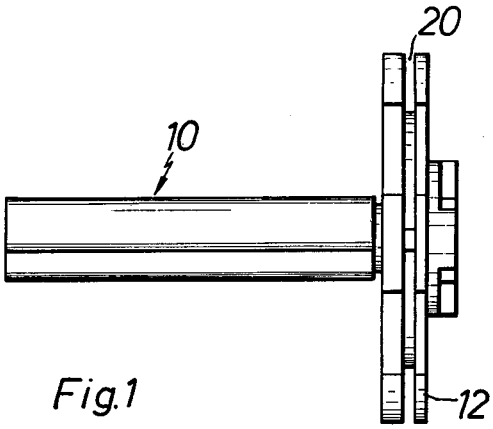
Fig. 1 is a view in side elevation of a common ejector means, the elastic casing engaging members being omitted therefrom.
Figure 2:
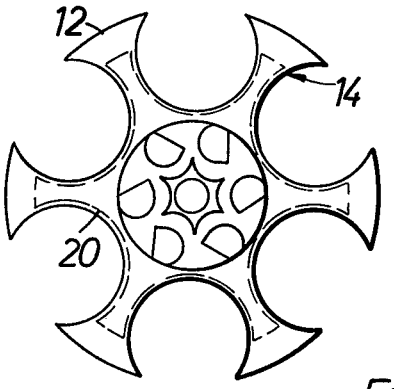
FIG. 2 is a view in end elevation of the ejecting means shown in FIG. 1, the view being taken in the direction from right to left in FIG. 1.

As has been mentioned above, the present invention relates to a revolver cylinder having an ejection mechanism which is made in such manner as to permit the use of rimless cartridges therein, such as, for example, 9 mm parabellum cartridges. In accordance with the invention, the head 12 of the common ejector means 10 has a continuous peripheral groove 20 which extends completely around the contour of the head. FIGS. 1 and 2 show the particular shape and disposition of the peripheral groove 20 in the illustrative embodiment. The groove 20 is positioned in the head 12 of the common ejector means 10 in such manner as to be accurately disposed in the same plane as the annular grooves 22 in the rear part of each of the cartridges when the cartridges are fully inserted into the respective chambers in the revolver cylinder with the ejector means in the solid line position thereof shown in FIG. 3, and also in the position thereof shown in FIG. 5. As shown most clearly in FIG. 5, the loaded cartridge has an annular shoulder between the outer cylindrical surface of the cartridge casing 24 and the ball or projectile 26, such shoulder accurately engaging a confronting annular shoulder 28 in the chamber 16 of the cylinder when the cartridge is fully inserted into the chamber. To summarize, when the loaded cartridge is fully inserted into the chamber 16 and the ejector means 10 is in its retracted position, the peripheral groove 20 of the head 12 of the ejector means and the annular groove 22 at the rear of the cartridge casing lie in the same transverse plane.

At the location of each cutout portion 14, that is to say, at the location of each of the cartridges, the peripheral groove 20 is provided with a small bent leaf spring 30. Referring now to FIGS. 4 and 6, each of the springs 30 is generally in the form of a symmetrical U, and more particularly, with the exception of its two opposite ends, is generally of semi-circular form. In the illustrative embodiment, each of the springs 30 has a section of right circular shape, as shown particularly in FIG. 5. The various springs 30, each one of which is disposed in a respective cutout portion 14 in the peripheral groove 20, is designed to be received at two diametrically opposed zones 32 and 34 in the annular groove 22 at the rear end of the casing of each of the respective cartridges when the cartridges are fully inserted into the respective chambers 16 of the revolver cylinder, as shown in FIG. 5, wherein the annular shoulder between the forward end of the cartridge casing and the projectile 26 is engaged with the annular shoulder 28 in the chamber 16 in the cylinder.

In accordance with the illustrative embodiment of the present invention, each of the springs 30 is held within the groove 20 only at a single central zone 36. This permits both legs or branches of the springs 30 to present a good elasticity. In the embodiment shown, the fixing of the central part of a spring 30 at a central point 36 is preferably done by welding the spring to the opposite walls of the groove 20 at such point; welds 38 for this purpose are shown in FIG. 5.

In order that the elastic means, here the springs 30 in the illustrative embodiment, are guided, said springs are provided with free ends of extremities 40 which are curved in opposite directions generally radially outwardly with respect to the interior of the U-shape of the springs to assure a perfect guidance of the free extremities of the springs 30 in the peripheral groove 20. Such ends 40 are thus guided in the interior of the peripheral groove 20 and are not apparent unless one looks at the chambers of the cylinder in the direction of its axis of rotation (FIG. 4).

It is to be understood that in the relaxed state of each of the springs 30 the distance between the zones 32 and 34 of the opposite arms of the spring is less than the root diameter of the annular groove 22 in the rear of the casing of each cartridge. As above-noted, because of the fixing of each spring in the groove 20 at the central point 36 of the spring, all of the flexibility of each of the branches of the spring is retained, thereby permitting the branches of the spring to be spread apart upon the introduction of the respective cartridge into the respective chamber 16 of the revolver cylinder 18. It should be pointed out that such introduction of the loaded cartridges in generally facilitated when the ball or projectile 26 is spherical, elliptical, or frusto-conical in longitudinal section, so that during the introduction of such cartridges into the chamber in the revolver cylinder there occurs a progressive forcing apart of the opposite branches of the respective spring 30. At the end of the insertion of the loaded cartridge, that is to say, when the cartridge casing 24 abuts the annular shoulder 28 in the chamber 16 of the revolver cylinder, the two free branches of a spring 30 are lodged or positioned within the annular groove 22 at the rear of the cartridge casing, the extremities 40 of the spring remaining in the peripheral groove 20 in the head 12 of the ejector 10. In FIG. 6 there are shown two positions of the arms 40 of the upper spring 30, the position shown in phantom lines and designated A being the position which the branches of the spring assume at the beginning of the introduction of a loaded cartridge into a chamber in the revolver cylinder and the position shown in solid lines and designated B showing the position which the branches of the spring 30 assume at the end of the introduction of the loaded cartridge into the chamber 16 of the revolver cylinder, that is to say, when the shoulder at the forward end of the cartridge casing abuts the annular shoulder 28 in the chamber 16.

As shown in FIG. 6, each of the ends 40 of the spring 30 remain guided within the interior of the annular groove 22 in the groove 20 of the ejector head 12, and that each of the springs 30 engages the root surface of the annular groove 22 of the cartridge casing at two diametrically opposed zones 32 and 34. When the ejector means 10 is moved into the cartridge case ejecting position shown at the right in FIG. 3, each spring 30, which is connected as we have seen at the central zone 36 thereof to the head 12 of the ejector, remains in engagement at the zones 30 and 34 with the root surface of the annular groove 22 in the rear of the cartridge casing. Such engagement of the springs with the cartridge casing permits the complete ejection of the casing while assuring the guiding of the casing until the last moment. The casing shown at the left in FIG. 3 can then be readily disengaged from the spring 30 and thus removed from the ejector. The ejection of the shell casings from the revolver cylinder may be effected manually or automatically or semi-automatically by conventional means, that is, that the ejecting means 10 simultaneously effects the ejection of all of the cartridge cases of fired cartridges or unfired cartridges simultaneously.

It is to be understood that the present invention is not limited to the particular embodiment described above which has been given as a non-limiting example. It is perfectly possible, without exceeding the bounds of the invention, to imagine different variations of the elastic means which engage within the annular groove provided in the rear part of the cartridge casing.

Although the invention is illustrated and described with reference to a single preferred embodiment thereof, it is to be noted that it is in no way limited to the disclosure of such a single embodiment, but is capable of numerous modifications within the scope of the appended claims.

What is claimed is:

1. A cylinder of a revolver having a plurality of chambers and provided with a mechanism for simultaneously ejecting a plurality of rimless cartridges therefrom, said mechanism comprising a collective ejector means provided with a head generally in the form of a disc presenting on its periphery a plurality of equally angularly spaced similar cutout portions adapted to the passage of cartridges therethrough, each cutout portion being essentially circular in form and being disposed in accurate alignment with a chamber of said plurality of chambers in the cylinder which receive the cartridges therewithin, the casings of said cartridges being flangeless and rimless but presenting an annular groove in the vicinity of the rear part of the cartridge disposed in the plane of the head of the ejector means, and cartridge retaining means disposed in the region of each cutout portion and adapted to engage within the annular groove in said cartridge, said retaining means cooperating with and engaging within such annular groove at the end of the introduction of the cartridges into the respective chambers in the revolver cylinder and until the complete ejection of the cartridges or casings, the head of the collective ejector means presents a peripheral groove which extends about the entire contour of the head provided with said cutout portions and which is disposed in such manner as to be located in the same plane as the annular groove in the rear part of the casings when the cartridges are fully inserted into the respective chambers in the revolver cylinder and the ejector means is retracted, said peripheral groove being adapted to receive the cartridge retaining means at the location of each cartridge at each cutout portion, said cartridge retaining means being elastic, such elastic retaining means being constituted by a plurality of generally U-shaped leaf springs which are of generally semi-circular form and which are adapted to engage in the annular groove in the rear end of a respective casing at two diametrically opposed zones.

2. Revolver cylinder according to claim 1, wherein each U-shaped spring has at the end of each of its two free branches a terminal part which is curved toward the exterior of the U, in such manner as to assure a guiding of the branches of such spring in the interior of the peripheral groove at each cutout portion corresponding to the head of the combined ejector means.

3. Revolver cylinder according to claim 2, wherein in their relaxed condition the two free branches of each of the U-shaped springs is spaced a distance less than the interior diameter of the annular groove in the casing.

4. Revolver cylinder according to claim 3, wherein each of said springs is fixed at a single point in the part of the peripheral groove of the head of the ejector means in the corresponding cutout portion, in such manner as to preserve the elasticity of the two free branches of the spring.

5. Revolver cylinder according to claim 4, wherein the spring is affixed to the said head of the ejector means by being welded thereto.

* * * * *